US010385496B2

(12) United States Patent
Hwang

(10) Patent No.: US 10,385,496 B2
(45) Date of Patent: Aug. 20, 2019

(54) WASHING MACHINE

(71) Applicant: Dongbu Daewoo Electronics Corporation, Seoul (KR)

(72) Inventor: Ui Kun Hwang, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 144 days.

(21) Appl. No.: 15/581,561

(22) Filed: Apr. 28, 2017

(65) Prior Publication Data

US 2018/0087205 A1 Mar. 29, 2018

(30) Foreign Application Priority Data

Sep. 27, 2016 (KR) ..... 10-2016-0124295

(51) Int. Cl.

| | |
|---|---|
| ***D06F 35/00*** | (2006.01) |
| ***D06F 33/00*** | (2006.01) |
| ***B01F 3/04*** | (2006.01) |
| ***D06F 33/02*** | (2006.01) |
| *D06F 17/06* | (2006.01) |
| *D06F 39/08* | (2006.01) |

(52) U.S. Cl.

CPC ..... *D06F 35/002* (2013.01); *B01F 3/0473* (2013.01); *D06F 33/02* (2013.01); *D06F 17/06* (2013.01); *D06F 39/083* (2013.01); *D06F 39/087* (2013.01); *D06F 2202/085* (2013.01); *D06F 2204/086* (2013.01)

(58) Field of Classification Search

CPC ..... D06F 17/06; D06F 35/002; B01F 3/0473
See application file for complete search history.

(56) References Cited

U.S. PATENT DOCUMENTS

| | | | | |
|---|---|---|---|---|
| 7,255,332 | B2 * | 8/2007 | Osborn | B01F 3/0473 210/221.2 |
| 9,060,916 | B2 * | 6/2015 | Cunningham | A61H 33/6036 |
| 2010/0179461 | A1 * | 7/2010 | Cunningham | A01K 13/001 601/154 |
| 2010/0199421 | A1 * | 8/2010 | Moon | A23N 12/02 4/602 |
| 2015/0176170 | A1 * | 6/2015 | Bae | D06F 35/002 68/183 |
| 2016/0305059 | A1 * | 10/2016 | Xu | D06F 39/08 |

* cited by examiner

*Primary Examiner* — Joseph L. Perrin

(57) ABSTRACT

A washing machine capable of generating bubbles from a water/air mixture and supplying bubbles to the tub to facilitate removal of residual detergent or the like from laundry during washing or rinsing operations. The washing machine has a dissolving unit with an air supply check valve and can receive air from outside of the dissolving unit in accordance with a pressure in the dissolving unit. Air contained in the dissolving unit can be dissolved in water contained therein to produce water/air mixture. A bubble generating unit receives the water/air mixture from the dissolving unit and generates bubbles as the mixture passes along a water flow path and a pressure reduction region in the bubble generating unit.

11 Claims, 6 Drawing Sheets

[FIG.1]
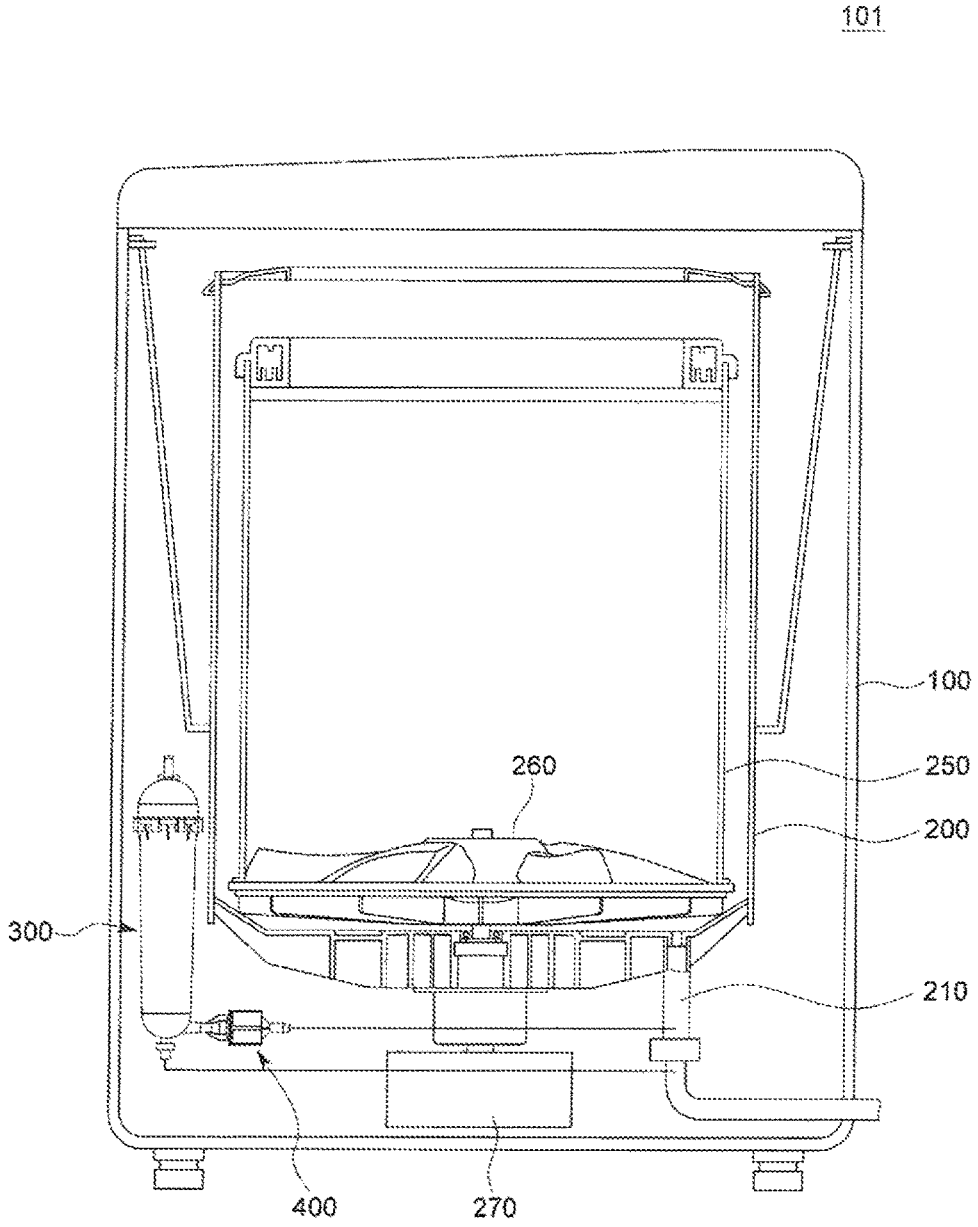

[FIG.2]
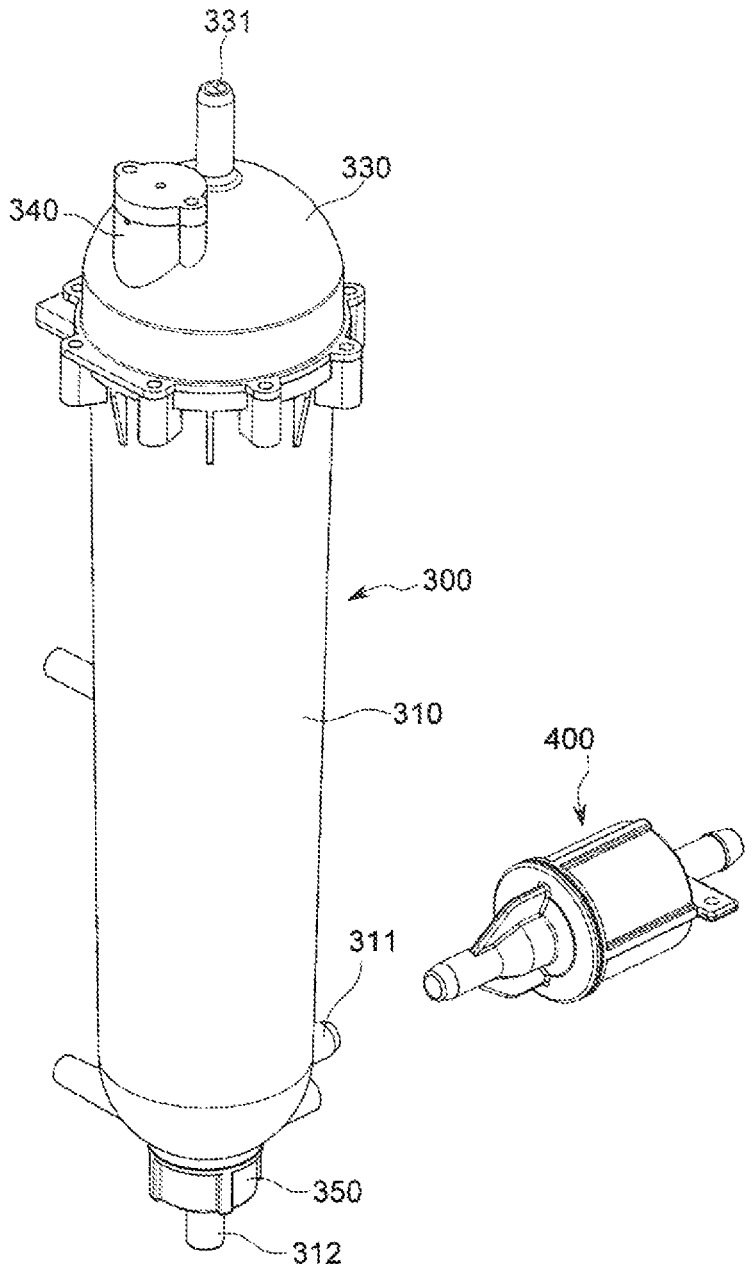

[FIG.3]
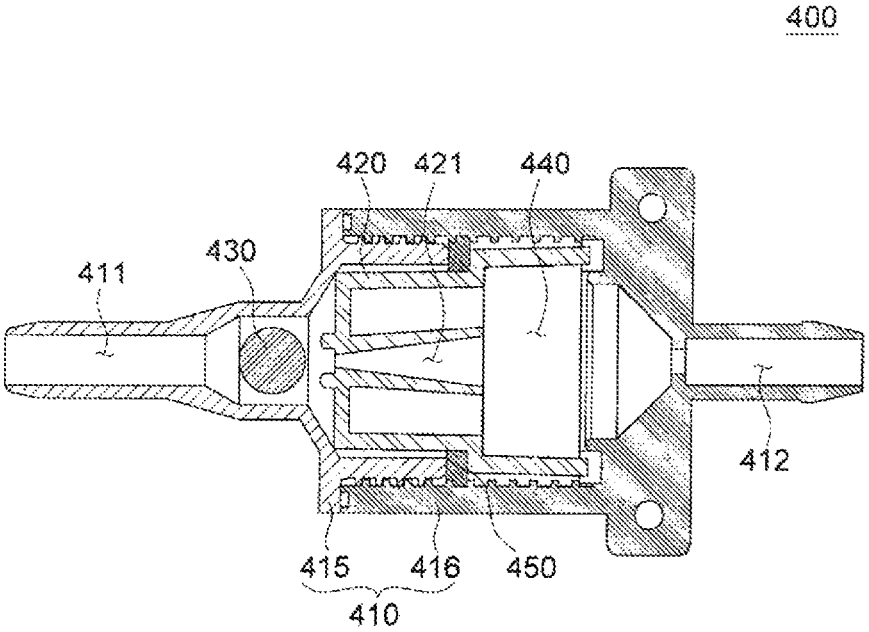

[FIG.4]
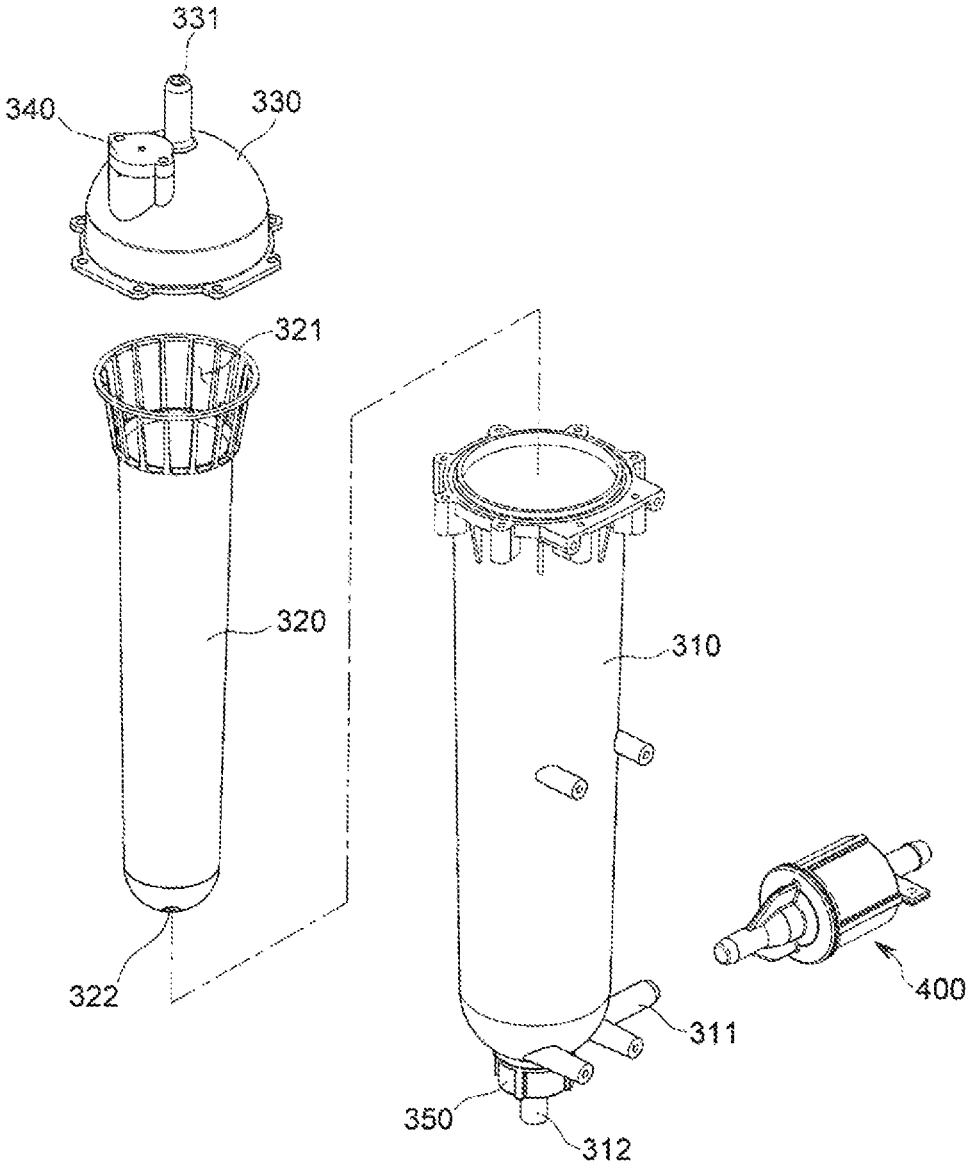

[FIG.5]
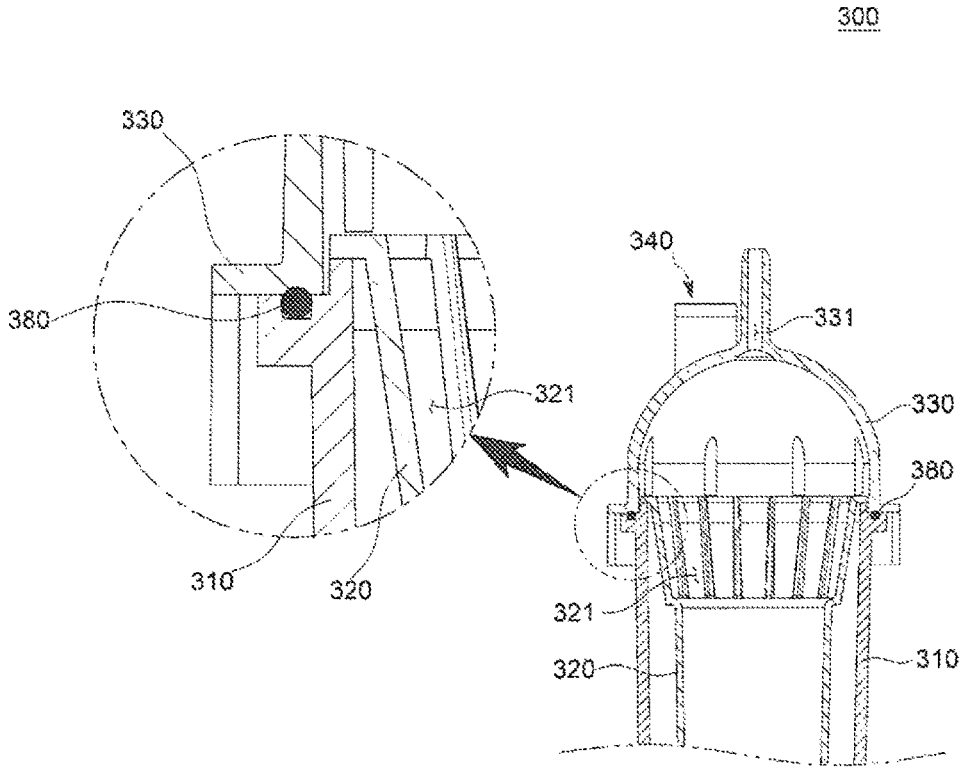

[FIG.6]
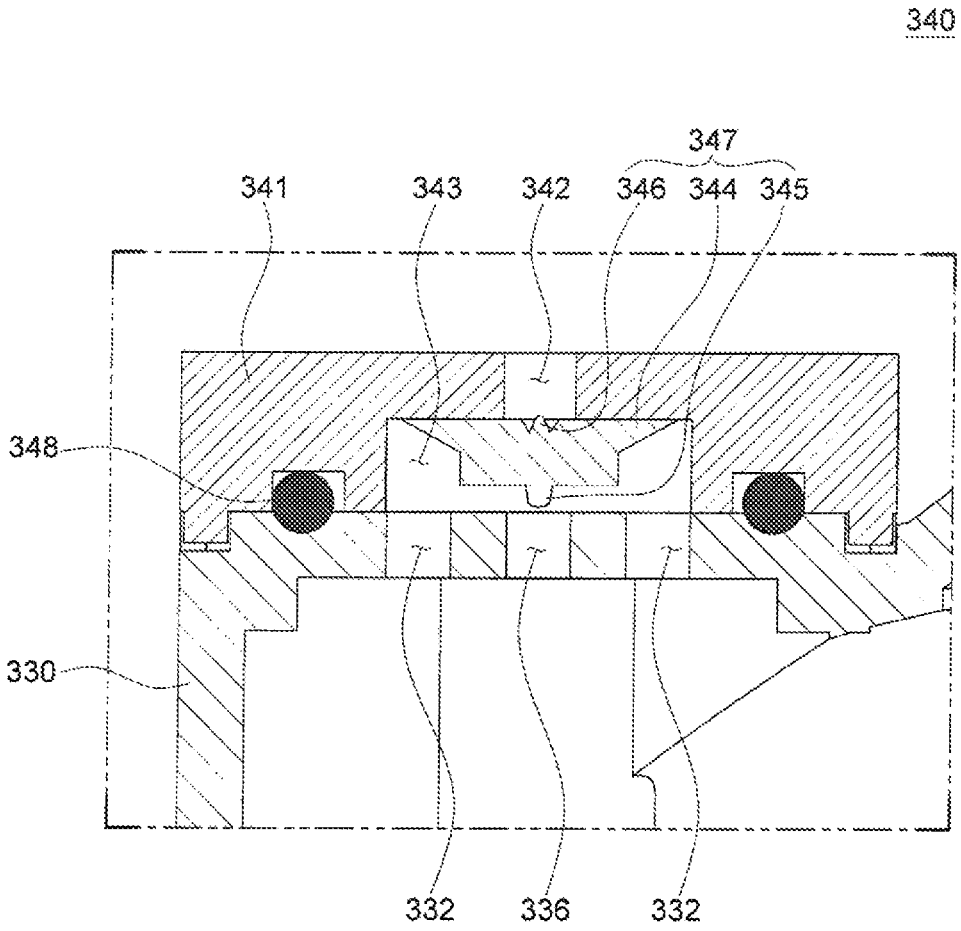

WASHING MACHINE

CROSS-REFERENCE TO RELATED APPLICATIONS

This application claims benefit and priority to Korean Patent Application No. 10-2016-0124295, filed on Sep. 27, 2016, with the Korean Intellectual Property Office, the disclosure of which is incorporated herein in its entirety by reference for all purposes.

TECHNICAL FIELD

Embodiments of the present disclosure relate to washing machines, and more particularly, to mechanisms of generating and supplying bubbles to facilitate removal of residual detergent on laundry.

BACKGROUND OF THE INVENTION

Basically, a washing machine washes laundry by creating friction between water and the laundry when a pulsator rotates in the drum of the washing machine. Holes on the drum allow water to flow between the tub and the drum. During a washing, rinsing, or spin-drying process, water can be discharged out of the tub through a drain line, e.g., installed at a lower side of the tub.

Sometimes, after laundry, there may be residual detergent or other foreign substances remaining on the washed clothes, which may cause irritating skin conditions of a user wearing the clothes, for example atopic dermatitis.

Various technologies have been developed to solve this problem, typically by supplying a concentrated water flow to the laundry clothes, which is generated by a separate device such as a pump. Unfortunately, the operations of such a pump produce noise, and it is difficult to perform maintenance on the pump after the pump is repeatedly used.

SUMMARY OF THE INVENTION

Embodiments of the present disclosure provide a washing machine operable to generate and supply bubbles to facilitate removal of residual detergent and foreign substances remaining on laundry and thereby enhance cleaning effectiveness.

An exemplary embodiment of the present disclosure provides a washing machine including a dissolving unit that has an air supply check valve. The dissolving unit can be filled with (and store) outside air in accordance with pressure in the dissolving unit, and mixes water supplied from the outside with stored air so that the stored air is dissolved in the supplied water. A bubble generating unit can generates bubble by allowing the water with dissolved air supplied from the dissolving unit to pass through the bubble generating unit.

The bubble generating unit may include: a bubble body which includes a bubble inlet port formed such that water with dissolved air is supplied from the dissolving unit, and a bubble discharge port through which the generated bubbles are discharged; and a bubble nozzle which is disposed inside the bubble body. The bubble generating unit includes a bubble flow path having an inner diameter increasing from the bubble inlet port to the bubble discharge port.

The bubble body may include: a first body which has one side at which the bubble inlet port is formed; and a second body which has one side to which the other side of the first body is detachably coupled, and the other side at which the bubble discharge port is formed.

The bubble flow path may be formed at one side of the bubble nozzle, where one side of the bubble nozzle may face an inner circumferential surface of the first body, and the second side of the bubble nozzle may face an inner circumferential surface of the second body. An interior of the second side of the bubble nozzle may be formed in a hollow shape so that the bubble flow path and the bubble discharge port communicate with each other.

The bubble generating unit may further include a pressure reduction region which is formed between an interior at the other side of the bubble nozzle and an interior of the second body and can reduce pressure of the bubbles passing through the bubble flow path.

The bubble generating unit may further include a bubble check valve which is disposed between the bubble inlet port and the bubble nozzle and opens and closes the bubble inlet port in accordance with pressure of the water with dissolved air introduced from the bubble inlet port.

The dissolving unit may include: a dissolving cap which has a dissolving inlet port through which the water supplied from the outside passes; an outer body which has an hollow interior, is formed to be opened at one side, is covered by the dissolving cap, and has a dissolving guide port formed at the other side of the outer body to guide the water with dissolved air so that the water with dissolved air is supplied into the bubble generating unit; an inner body which is opened at one side, is supported by one side of the outer body, and is disposed in the outer body such that an outer circumferential surface of the inner body is spaced apart from an inner circumferential surface of the outer body to form a dissolving flow path; and a porous portion which is formed at one side of the inner body and guides the water introduced into the inner body so that the water overflows to the dissolving flow path.

The air supply check valve may include: a communication hole which is formed in the dissolving cap to be spaced apart from the dissolving inlet port; an air supply cover which is coupled to the dissolving cap, and having an air supply hole formed at one side of the air supply cover so that outside air is introduced through the air supply hole, and an installation region formed at the other side of the air supply cover to communicate with the communication hole; and an air supply valve which is installed in the installation region and allows the air supply hole and the communication hole to selectively communicate with each other in accordance with internal pressure in the dissolving unit.

The air supply check valve may further include a valve support hole which is formed in the dissolving cap and supports the air supply valve, and a plurality of communication holes may be formed around the valve support hole.

A diameter of one end portion of the air supply valve may be relatively larger than a diameter of the air supply hole to close the air supply hole, and a diameter of the other end portion of the air supply valve may be relatively smaller than the diameter of one end portion of the air supply valve.

The air supply valve may include an air supply protrusion that protrudes from the other end portion of the air supply valve toward the valve support hole.

An exemplary embodiment of the present disclosure provides a washing machine including: a housing; a tub which is installed in the housing; and a dissolving unit that is disposed between the housing and the tub and can be filled with (and store) outside air in accordance with pressure in the dissolving unit. The dissolving unit can mix water supplied from the outside and stored air so that the stored air is dissolved in the supplied water.

According to the exemplary embodiments of the present disclosure, the washing machine supplies the bubbles to the laundry, which can decrease surface tension between the laundry and detergent or foreign substances remaining on the laundry, thereby effectively cleaning the laundry.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 1 illustrates the configuration of an exemplary washing machine according to an embodiment of the present disclosure.

FIG. 2 illustrates the configurations of an exemplary dissolving unit and an exemplary bubble generating unit in the washing machine shown in FIG. 1.

FIG. 3 illustrates the cross section of the exemplary bubble generating unit in FIG. 2.

FIG. 4 is an exploded perspective view illustrating the configuration of the exemplary dissolving unit in FIG. 2.

FIG. 5 illustrates a cross section of the exemplary dissolving unit in FIGS. 2 and 4.

FIG. 6 illustrates a cross section of an exemplary air supply check valve in FIG. 2.

DETAILED DESCRIPTION

In the following detailed description, reference is made to the accompanying drawings, which form a part hereof. The illustrative embodiments described in the detailed description, drawings, and Claims are not meant to be limiting. Other embodiments may be utilized, and other changes may be made, without departing from the spirit or scope of the subject matter presented here.

Hereinafter, an exemplary embodiment of the present disclosure will be described in detail with reference to the accompanying drawings so that those skilled in the technical field to which the present disclosure pertains may carry out the exemplary embodiment. The present disclosure may be implemented in various different ways, and is not limited to the exemplary embodiments described herein.

It is noted that the drawings are schematic, and are not illustrated based on actual scales. Relative dimensions and proportions of parts illustrated in the drawings are exaggerated or reduced in size for the purpose of clarity and convenience in the drawings, and any dimension is just illustrative and not restrictive. The same reference numerals designate the same structures, elements or components illustrated in two or more drawings in order to exhibit similar characteristics.

Exemplary drawings of the present disclosure illustrated exemplary embodiments of the present disclosure in detail. As a result, various modifications of the drawings are expected. Therefore, the exemplary embodiments are not limited to specific forms illustrated in the drawings, and for example, may include modifications of form for manufacture.

Hereinafter, a washing machine 101 according to an exemplary embodiment of the present disclosure will be described with reference to FIGS. 1 to 6.

As illustrated in FIGS. 1 and 2, the washing machine 101 according to the exemplary embodiment of the present disclosure includes a dissolving unit 300 including an air supply check valve 340 and a bubble generating unit 400.

During operation, water is supplied into the dissolving unit 300 from the outside. The dissolving unit 300 can store air. The air supply check valve 340 allows outside air to enter the dissolving unit 300 in accordance with pressure in the dissolving unit 300. More specifically, air in the dissolving unit 300 is dissolved in water that is supplied from the outside, producing a water/air mixture.

The bubble generating unit 400 can generate bubbles from the water/air mixture provided from the dissolving unit 300. Bubbles generated from the bubble generating unit 400 can be supplied to the laundry during a washing, rinsing, or another operation cycle. The bubbles can advantageously facilitate removal of detergent or foreign substances adherent to the laundry.

As illustrated in FIG. 3, the bubble generating unit 400 according to the exemplary embodiment of the present disclosure may include a bubble body 410 and a bubble nozzle 420.

The bubble body 410 may include a bubble inlet port 411 and a bubble discharge port 412. The bubble inlet port 411 can guide the water containing dissolved air (or the water/air mixture) from the dissolving unit 300 to the bubble generating unit 400. The bubble discharge port 412 may guide bubbles out of the bubble generating unit 400 and allow the bubbles to be supplied into a tub of the washing machine 101, for example.

The bubble nozzle 420 may be disposed inside the bubble body 410. The bubble nozzle 420 may include a bubble flow path 421 that has an inner diameter increasing from the bubble inlet port 411 to the bubble discharge port 412. When the water/air mixture enters the bubble inlet port 411, the mixture may be deaerated while passing through the bubble flow path 421, thereby generating bubbles.

Therefore, the bubble generating unit 400 can generate bubbles when water containing dissolved air passes through the bubble flow path 421 formed in the bubble nozzle 420.

As illustrated in FIG. 3, the bubble body 410 of the washing machine 101 may include a first body 415 and a second body 416.

The bubble inlet port 411 may be disposed at the first side of the first body 415. The first side of the second body 416 is detachably coupled to the second side of the first body 415. More specifically, there are screw threads formed on an outer circumferential surface of the second side of the first body 415. Screw threads may be formed on an inner circumferential surface at the first of the second body 416 and can be engaged with the screw threads formed on the outer circumferential surface of the first body 415.

The bubble discharge port 412 may be formed at the second side of the second body 416. The bubble inlet port 411 and the bubble discharge port 412 may be configured to be coaxial. The bubble nozzle 420 may be disposed between the second side of the first body 415 and the first side of the second body 416.

Thus, after the water/air mixture enters the bubble inlet port 411 of the first body 415, bubbles can be generated when the mixture passes through the bubble flow path 421 of the bubble nozzle 420. Bubbles may then be discharged out of the bubble generating unit 400 through the bubble discharge port 412 of the second body 416.

As shown, the first body 415 and the second body 416 may be detachably coupled to each other. If a foreign substance or the like are trapped in the bubble flow path 421 formed in the bubble nozzle 420, the foreign substance can be easily removed by a user by decoupling the first body 415 and the second body 416. During installation, the first body 415, the second body 416, and the bubble nozzle 420) to be disposed between the first body 415 and the second body 416) may be easily assembled together, e.g., by an operator.

As illustrated in FIG. 3, the bubble nozzle 420 according to the exemplary embodiment of the present disclosure may be disposed between the first body 415 and the second body 416.

The bubble flow path 421 may be formed at the first side of the bubble nozzle 420. An outer circumferential surface at the first side of the bubble nozzle 420 may face an inner circumferential surface of the first body 415.

The second side of the bubble nozzle 420 may be hollow. An outer circumferential surface at the second side of the bubble nozzle 420 may face an inner circumferential surface of the second body 416. The diameter at the first side of the bubble nozzle 420 may be smaller than the diameter of at the second side of the bubble nozzle 420. Therefore, the inner circumferential surface at the first side of the second body 416 may face the outer circumferential surface at the second side of the first body 415 as well as the outer circumferential surface at the second side of the bubble nozzle 420.

Since the second side of the bubble nozzle 420 is hollow, the bubble flow path 421 formed at the first side of the bubble nozzle 420 and the bubble discharge port 412 disposed at the second side of the second body 416 may communicate with each other.

As illustrated in FIG. 3, the bubble generating unit 400 according to the exemplary embodiment of the present disclosure may further include a nozzle sealing member 450 disposed between the second side of the first body 415 and the second side of the bubble nozzle 420.

The nozzle sealing member 450 is disposed between the outer circumferential surface at the first side of the bubble nozzle 420 and the inner circumferential surface of the second body 416. The nozzle sealing member can prevent bubbles from leaking into the gap between the first body 415 and the second body 416.

The bubble generating unit 400 according to the exemplary embodiment of the present disclosure may further include a pressure reduction region 440.

The pressure reduction region 440 may be disposed between the bubble nozzle 420 and the bubble discharge port 412. More specifically, the pressure reduction region 440 may be formed between the hollow interior at the second side of the bubble nozzle 420 and an interior of the second body 416 that corresponds to the hollow interior at the second side of the bubble nozzle 420. In the pressure reduction region 440, bubbles are collected and the pressure of the bubbles is reduced. The bubbles are then discharged through the bubble discharge port 412.

As illustrated in FIG. 3, the bubble generating unit 400 according to the exemplary embodiment of the present disclosure may further include a bubble check valve 430.

The bubble check valve 430 may be disposed between the bubble inlet port 411 and the bubble nozzle 420. More specifically, the bubble check valve 430 can operate to open the bubble inlet port 411 based on the pressure of the water/air mixture introduced from the bubble inlet port 411. The bubble check valve 430 allows the mixture to pass through the bubble inlet port 411 and flow in the bubble flow path 421 of the bubble nozzle 420. If a reverse flow occurs (the water/air mixture flows from the bubble discharge port 412, through the bubble flow path 421, and then to bubble inlet port 411), the bubble check valve 430 may close the bubble inlet port 411, thereby preventing the water/air mixture from flowing back into the dissolving unit 300. Thus, the bubble check valve 430 can control the water/air mixture to flow only in one direction.

As illustrated in FIG. 4, the dissolving unit 300 according to the exemplary embodiment of the present disclosure may include a dissolving cap 330, an outer body 310, an inner body 320, and a porous portion 321.

A dissolving inlet port 331 is disposed in the dissolving cap 330 to receive water supplied from the outside. The dissolving cap 330 may be formed approximately in a hemispheric shape, and the dissolving inlet port 331 may be disposed on the top of the dissolving cap 330.

The outer body 310 may be hollow and opens at the first side. The second side of the outer body 310 may be approximately hemispheric. Thus, a longitudinal cross section of the outer body 310 is approximately "U" shaped.

The dissolving cap 330 may be coupled to the open side (the first side) of the outer body 310. Air can be contained in the space defined by the dissolving cap 330 and the outer body 310.

The inner body 320 may open at the first side and is approximately hemispheric at the second side. The inner body 320 may be disposed inside the outer body 310. The space between an outer circumferential surface of the inner body 320 and an inner circumferential surface of the outer body 310 forms a dissolving flow path. The first side of the inner body 320 may be held and supported by the first side of the outer body 310. More specifically, the first end portion of the inner body 320 may be held and supported by the open side of the outer body 310. That is, an area at the first side of the inner body 320 has a larger diameter than the rest of the inner body 320, such that the first side of the inner body 320 may be held and supported by the open side of the outer body 310. Also, the dissolving flow path is formed between the outer circumferential surface of the rest of the inner body 320 and the inner circumferential surface of the outer body 310. For example, as illustrated in FIG. 5, the first side of the outer body 310 may be coupled to the dissolving cap 330, and may also support the inner body 320. specifically, the dissolving unit 300 may include an airtightness member 380 is provided in the coupling region between the dissolving cap 330 and the outer body 310 so as to providing an air seal for the space defined by the dissolving cap 330 and the outer body 310.

The porous portion 321 may be formed at the first side of the inner body 320. The porous portion 321 may guide water introduced into the inner body 320 through the dissolving inlet port 331 so that the water flows inside and along a longitudinal direction of the inner body 320 and then overflows to the dissolving flow path. While water flowing through the inner body 320, the porous portion 321, and the dissolving flow path, air stored in the dissolving unit 300 may be mixed with the water.

Thus, without a separate agitating device, water supplied through the dissolving inlet port 331 can dissolve air stored in the dissolving unit 300 while water flows through the inner body 320, the porous portion 321, and the dissolving flow path.

As illustrated in FIG. 6, the air supply check valve 340 according to the exemplary embodiment of the present disclosure may include a communication hole 332, an air supply cover 341, and an air supply valve 347.

The communication hole 332 may be formed in the dissolving cap 330. More specifically, the communication hole 332 may be spaced apart from the dissolving inlet port 331. An air supply airtightness member 348 is installed between the air supply cover 341 and the dissolving cap 330, which provides an air seal for the dissolving unit 300.

As an example, the dissolving cap 330 has a hemispheric portion and the communication hole 332 is formed at the top of the hemispheric portion.

An air supply hole 342 may be formed at the first side of the air supply cover 341. The air supply hole 342 allows outside air to enter the dissolving unit 300. An installation region 343 may be disposed at the second side of the air supply cover 341. The installation region 343 may be a groove on the second side of the air supply cover 341. The installation region 343 allows the communication hole 332 and the air supply hole 342 to communicate with each other.

The air supply cover 341 may be coupled to the dissolving cap 330. More specifically, the air supply cover 341 may be coupled to the protruding area (hemispheric portion) of the dissolving cap 330 where the communication hole 332 is formed.

The air supply valve 347 may be installed in the installation region 343. The air supply valve 347 may allow the air supply hole 342 and the communication hole 332 to selectively communicate with each other in accordance with the internal pressure of the dissolving unit 300. More specifically, the air supply valve 347 may close the air supply hole 342 by force of the air pressure in the dissolving unit 300 when the internal pressure in the dissolving unit 300 is equal to or higher than a preset pressure. When the internal pressure in the dissolving unit 300 is lower than the preset pressure, the air supply valve 347 may allow the air supply hole 342 and the communication hole 332 to communicate with each other to let outside air flow into the dissolving unit 300. In this manner, the air supply valve 347 may allow the air supply hole 342 and the communication hole 332 to selectively communicate with each other in accordance with the internal pressure in the dissolving unit 300 without a separate electronic drive means. As an example, the air supply valve 347 may include an elastic material.

As illustrated in FIG. 6, the air supply check valve 340 according to the exemplary embodiment of the present disclosure may further include a valve support hole 336.

The valve support hole 336 may be formed in the dissolving cap 330 and spaced apart from the communication hole 332. The valve support hole 336 may support the air supply valve 347. That is, the air supply valve 347 may contact the dissolving cap 330 and the air supply cover 341 and fit in the valve support hole 336 and the air supply hole 342.

A plurality of communication holes 332 may be formed around the valve support hole 336. As an example, the communication holes 332 may be symmetrically disposed around a center of the valve support hole 336. The valve support hole 336 and the air supply hole 342 may be coaxial.

That is, the installation region 343 formed in the air supply cover 341 may be formed to cover the plurality of communication holes 332.

As illustrated in FIG. 6, the first end portion of the air supply valve 347 has a larger diameter than the second end portion of the air supply valve 347.

The first end portion of the air supply valve 347 may be larger than the air supply hole 342. The first end portion of the air supply valve 347 may selectively come into contact with the air supply cover 341 to open and close the air supply hole 342.

The second end portion of the air supply valve 347 may be smaller than the the first end portion of the air supply valve 347. The second end portion of the air supply valve 347 can cover and fit in the valve support hole 336.

The thickness of the valve lip 344 decreases along a direction away from a central portion of the air supply hole 342 and may be disposed at the end portion of the air supply valve 347. A valve protrusion 346 may be formed on the air supply valve 347 and face the air supply hole 342. More specifically, an inclined surface of the valve lip 344 may face the plurality of communication holes 332. Thus, as air stored in the dissolving unit 300 presses the inclined surface of the valve lip 344 through the communication hole 332, the first end portion of the air supply valve 347 may close the air supply hole 342 to prevent air from being discharged out of the dissolving unit 300 through the communication hole 332.

The air supply valve 347 according to the exemplary embodiment of the present disclosure may include an air supply protrusion 345. The air supply protrusion 345 may be disposed on the second end portion of the air supply valve 347. The air supply protrusion 345 may protrude toward the valve support hole 336.

Therefore, when the pressure in the dissolving unit 300 is lower than the preset pressure, air supplied through the air supply hole 342 may pass between the first end portion of the air supply valve 347 and the installation region 343, and may enter the dissolving unit 300 through the communication hole 332. In this case, the air supply protrusion 345 of the air supply valve 347 is inserted into the valve support hole 336 such that the air supply valve 347 does not shift from the designated position due to the air flow around the periphery of the air supply valve 347. This can prevent the air supply valve 347 from hindering air flow into the communication hole 332.

As illustrated in FIG. 1, the washing machine 101 according to the exemplary embodiment of the present disclosure includes a housing 100, a tub 200, and a dissolving unit 300. The housing 100 defines an exterior of the washing machine 101.

The tub 200 is installed in the housing 100 and can contain washing water. More specifically, the tub 200 is disposed in the housing 100 and spaced apart from an inner wall of the housing 100.

The dissolving unit 300 is filled with air flowing from outside in accordance with pressure in the dissolving unit 300. Water is supplied into the dissolving unit 300 from the outside to dissolve air in the dissolving unit. The dissolving unit 300 is disposed between the housing 100 and the tub 200. More specifically, the dissolving unit 300 is disposed to be closer to a lower side of the tub 200 than the open upper side of the tub 200. Therefore, as the tub 200 is supported by the housing 100 by a suspension system, the dissolving unit 300 may be installed between a lower side of the housing 100 and the lower side of the tub 200 without interference with the tub 200 and with sufficient installation space.

Hereinafter, an exemplary operational process of the washing machine 101 is described with reference to FIGS. 1 to 6.

As illustrated in FIG. 1, the washing machine 101 includes the housing 100, the tub 200 that is disposed in the housing 100 and can contain washing water, the washing tub 250 disposed in the tub 200 and configured to accommodate laundry, a pulsator 260 disposed in the washing tub 250, a drive unit 270 that can drive the rotation of the pulsator 260 and the washing tub 250, and a drain line 210 installed at the lower side of the tub 200 for discharging washing water out of the tub 200.

With a water supply unit (not illustrated) that supplied washing water, the water can be supplied into the dissolving unit 300 through the dissolving inlet port 331 of the dissolving unit 300. Water flows inside the dissolving unit 300 and can dissolve air contained in the dissolving unit 300. More specifically, water flows through the dissolving inlet port 331 and the inner body 320 and can be contained inside the inner body 320. Thus, water newly supplied through the dissolving inlet port 331 and the water contained inside the inner body 320 encountered each other and merge. As water flows along the inside wall of the inner body 320 and accumulates inside the inner body 320, it can overflow through the porous portion 321 and then flow along the dissolving flow path formed between the outer body 310 and the inner body 320. The porous portion 321 is coupled to the open side of the inner body 320. Water can dissolve air during the course of flowing inside the dissolving unit. No separate pump or agitating device is needed for dissolving air in the water.

Water overflowing to the dissolving flow path can be mixed with air contained in the dissolving unit 300, thereby producing a water/air mixture that can be supplied into the bubble generating unit 400 through the dissolving guide port 311.

While the water/air mixture enters the bubble inlet port 411 and passes through the bubble flow path 421 of the bubble nozzle 420, air can be separated from the water/air mixture and so bubbles are generated, e.g., micro bubbles. The generated bubbles may be discharged out of the bubble generating unit 400 through the bubble discharge port 412, and then supplied into the tub 200.

Bubbles can reduce surface tension between detergent or foreign substances and laundry, thereby allowing the laundry to be effectively cleaned.

The washing machine 101 may further include a control unit and a water level sensor. The dissolving unit 300 may further include an inner hole 322, a dissolving drain port 312, and a discharge check valve 350.

The inner hole 322 may be formed at the bottom of the second side of the inner body 320. The inner hole 322 allows the interior of the inner body 320 and the dissolving flow path to communicate with each other. Further, the inner hole 322 should be small enough to prevent water introduced into the inner body 320 from being discharged directly to the dissolving flow path.

The dissolving drain port 312 is disposed in the outer body 310. The dissolving drain port 312 may be disposed at the bottom of the outer body 310. The dissolving drain port 312 may discharge the water that is not supplied into the bubble generating unit 400 to the outside of the dissolving unit 300.

The discharge check valve 350 may selectively open and close the dissolving drain port 312. More specifically, the discharge check valve 350 may open the dissolving drain port 312 when the water remaining in the dissolving unit 300 is at or lower than a predetermined level. That is, the discharge check valve 350 may close the dissolving drain port 312 in accordance with a pressure or a level of water introduced into the dissolving unit 300 while water is supplied through the water supply port.

The control unit may determine whether the bubble generating unit 400 cannot effectively generate bubbles based on the amount of water supplied into the dissolving unit 300 and the amount of air consumed in the dissolving unit 300. More specifically, the water level sensor can detect a level of water introduced into the dissolving unit 300. Based on the detection, the control unit may determine whether the amount of the air currently remaining in the dissolving unit 300 can allow the bubble generating unit 400 to effectively generate bubbles.

When the detected level of the water is higher than a predetermined level preset in the control unit, the control unit instructs the water supply unit to stop supplying water into the dissolving inlet port 331. In this case, water with dissolved air already stored in the dissolving unit 300 is supplied into the bubble generating unit 400, and thus the level of the water in the dissolving unit 300 is gradually decreased.

When water remaining in the dissolving unit 300 is insufficient to press the bubble check valve 430 of the bubble generating unit 400, the bubble inlet port 411 and the bubble flow path 421 cannot communicate with each other. In this situation, the discharge check valve 350 may open the dissolving drain port 312 so that water with dissolved air remaining in the dissolving unit 300 can be discharged to the outside of the dissolving unit 300. More specifically, water can be discharged out of the dissolving unit 300 through the dissolving drain port 312 and then flow through the drain line 210 installed at the lower side of the tub 200.

In this way, the pressure in the dissolving unit 300 is decreased, and the air supply check valve 340 is opened. More specifically, the air supply protrusion 345 of the air supply valve 347 is inserted into the valve support hole 336, and the outside air passes between the air supply valve 347 and the installation region 343 through the air supply hole 342, and is introduced into the dissolving unit 300 through the communication hole 332. The air introduced into the air supply check valve 340 may assist the remaining water to be effectively discharged to the drain line 210 through the dissolving drain port 312.

As the air supply valve 347 allows the communication hole 332 and the air supply hole 342 to communicate with each other and thus the outside air can continuously flow into the dissolving unit 300, the discharge check valve 350 may close the dissolving drain port 312 by the air introduced into the dissolving unit 300.

When the interior of the dissolving unit 300 is filled with enough air, the air supply valve 347 is moved upward to close the air supply hole 342 by the air pressure in the dissolving unit 300. In this case, the air in the dissolving unit 300 presses the other end portion of the air supply valve 347 through the communication hole 332 and the valve support hole 336, and the first end portion of the air supply valve 347 comes into contact with the installation region 343, such that the closed state of the air supply hole 342 is maintained.

Thereafter, the control unit may control the water supply unit to supply water into the dissolving unit 300 as needed or based on a preset operational program.

With the aforementioned configuration, the washing machine 101 according to the exemplary embodiment of the present disclosure may effectively generate bubbles used to facilitate removal of foreign substances or residual detergent attached to the laundry.

While the exemplary embodiments of the present disclosure have been described with reference to the accompanying drawings, those skilled in the art will understand that the present disclosure may be implemented in any other specific form without changing the technical spirit or an essential feature thereof.

Accordingly, it should be understood that the aforementioned exemplary embodiment is described for illustration in all aspects and is not limited, and the scope of the present disclosure shall be represented by the Claims to be described below, and it should be construed that all of the changes or modified forms induced from the meaning and the scope of the Claims, and an equivalent concept thereto are included in the scope of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following Claims.

What is claimed is:

1. A washing machine comprising:

a dissolving unit comprising an air supply check valve, wherein the dissolving unit is configured to:

receive a supply of water and air respectively from outside of the dissolving unit, wherein air is supplied to the dissolving unit in accordance with an air pressure in the dissolving unit; and provide a mixture of water and air comprising air dissolved in the water; and a bubble generating unit coupled to the dissolving unit and configured to:

receive the mixture of water and air; and generate bubbles from the mixture of water and air, wherein the dissolving unit comprises:

a dissolving cap that comprises a dissolving inlet port configured to receive water supplied from outside of the dissolving unit;

an outer body comprising a hollow interior and a first side that is open, wherein the outer body is covered by the dissolving car and further comprises a dissolving guide port disposed at a second side of the outer body, wherein the dissolving guide port is configured to guide the mixture of water and air into the bubble generating unit; and an inner body comprising a first side that is open and supported by the first side of the outer body, wherein a space between an outer circumferential surface of the inner body and an inner circumferential surface of the outer body forms a dissolving flow path; and a porous portion disposed at the first side of the inner body and configured to allow water in the inner body to overflow to the dissolving flow path, wherein the air supply check valve comprises:

a communication hole formed in the dissolving cap and spaced apart from the dissolving inlet port;

an air supply cover coupled to the dissolving can and comprising an air supply hole disposed at a first side of the air supply cover, wherein the air supply hole is configured to allow air to enter the dissolving unit, wherein the air supply cover further comprises an installation region formed at a second side of the air supply cover and configured to communicate with the communication hole;

an air supply valve disposed in the installation region and configured to allow the air supply hole and the communication hole to selectively communicate with each other in accordance with an internal pressure in the dissolving unit; and a valve support hole formed in the dissolving cap and configured to support the air supply valve, and wherein further a plurality of communication holes are formed around the valve support hole, wherein a first end portion of the air supply valve has a larger diameter than the air supply hole and operable to close the air supply hole, and wherein a second end portion of the air supply valve has a smaller diameter than the first end portion of the air supply valve, and wherein the air supply valve comprises an air supply protrusion that protrudes from the second end portion of the air supply valve toward the valve support hole.

2. The washing machine of claim 1, wherein the bubble generating unit comprises a bubble body comprising:

a bubble inlet port configured to receive the mixture of water and air provided from the dissolving unit; and a bubble discharge port configured to discharge bubbles from the bubble generating unit.

3. The washing machine of claim 2, wherein the bubble generating unit further comprises a bubble nozzle disposed inside the bubble body and coupled between the bubble inlet port and the bubble discharge port, wherein the bubble nozzle comprises a bubble flow path that has an inner diameter increasing from the bubble inlet port to the bubble discharge port.

4. The washing machine of claim 3, wherein the bubble body further comprises:

a first body, wherein the bubble inlet port is disposed on a first side of the first body; and a second body, wherein a first side of the second body is detachably coupled to a second side of the first body, and wherein the bubble discharge port is disposed on a second side of the second body.

5. The washing machine of claim 4, wherein the bubble flow path is formed at a first side of the bubble nozzle, wherein the first side of the bubble nozzle faces an inner circumferential surface of the first body, a second side of the bubble nozzle faces an inner circumferential surface of the second body, and wherein the second side of the bubble nozzle is hollow, and wherein further the bubble flow path and the bubble discharge port are configured to communicate with each other through the bubble nozzle.

6. The washing machine of claim 5, wherein the bubble generating unit further comprises a pressure reduction region configured to reduce pressure of bubbles passing through the bubble flow path.

7. The washing machine of claim 6, wherein the pressure reduction region is formed between an interior of the second side of the bubble nozzle and an interior of the second body.

8. The washing machine of claim 3, wherein the bubble generating unit further comprises a bubble check valve disposed between the bubble inlet port and the bubble nozzle, wherein the bubble check valve is configured to open and close the bubble inlet port in accordance with pressure of the mixture of water and air introduced from the bubble inlet port.

9. A washing machine comprising:

a housing;

a tub installed in the housing; and a dissolving unit disposed between the housing and the tub and configured to receive and contain outside air in accordance with an air pressure in the dissolving unit, wherein the dissolving unit is further configured to receive water supplied from outside and allow water to dissolve air to generate a mixture of water and air;

wherein the dissolving unit comprises:

a dissolving cap that comprises a dissolving inlet port configured to receive water supplied from outside of the dissolving unit;

an outer body comprising a hollow interior and a first side that is open, wherein the outer body is covered by the dissolving cap and further comprises a dissolving guide port disposed at a second side of the outer body, wherein the dissolving guide port is configured to guide the mixture of water and air into the bubble generating unit; and an inner body comprising a first side that is open and supported by the first side of the outer body, wherein a space between an outer circumferential surface of the inner body and an inner circumferential surface of the outer body forms a dissolving flow path; and a porous portion disposed at the first side of the inner body and configured to allow water in the inner body to overflow to the dissolving flow path, a communication hole formed in the dissolving cap and spaced apart from the dissolving inlet port;

an air supply cover coupled to the dissolving cap and comprising an air supply hole disposed at a first side of the air supply cover, wherein the air supply hole is configured to allow air to enter the dissolving unit, wherein the air supply cover further comprises an installation region formed at a second side of the air supply cover and configured to communicate with the communication hole;

an air supply valve disposed in the installation region and configured to allow the air supply hole and the communication hole to selectively communicate with each other in accordance with an internal pressure in the dissolving unit; and a valve support hole formed in the dissolving cap and configured to support the air supply valve, and wherein further a plurality of communication holes are formed around the valve support hole, wherein a first end portion of the air supply valve has a larger diameter than the air supply hole and operable to close the air supply hole, and wherein a second end portion of the air supply valve has a smaller diameter than the first end portion of the air supply valve, and wherein the air supply valve comprises an air supply protrusion that protrudes from the second end portion of the air supply valve toward the valve support hole.

10. The washing machine of claim 9 further comprising a bubble generating unit coupled to the dissolving unit and configured to receive the mixture of water and air to generate bubbles for supply to the tub.

11. The washing machine of claim 10, wherein the bubble generating unit comprises a pressure reduction region.

* * * * *